United States Patent [19]

Warne

[11] 4,094,800

[45] June 13, 1978

[54] ANTI-WEAR LUBRICATING OIL COMPOSITIONS

[75] Inventor: Thomas M. Warne, Wheaton, Ill.

[73] Assignee: Standard Oil Company (Indiana), Chicago, Ill.

[21] Appl. No.: 794,983

[22] Filed: May 9, 1977

Related U.S. Application Data

[63] Continuation-in-part of Ser. No. 705,128, Jul. 14, 1976, abandoned.

[51] Int. Cl.[2] ..... C10M 1/48; C10M 3/42; C10M 5/24; C10M 7/46

[52] U.S. Cl. ..... 252/32.7 E; 252/32.7 R

[58] Field of Search ..... 252/32.7 E, 32.7 R; 260/429.9

[56] References Cited

U.S. PATENT DOCUMENTS

| | | | |
|---|---|---|---|
| 2,794,780 | 6/1957 | Wiptrach et al. | 260/429.9 X |
| 3,086,939 | 4/1963 | Tichelaar et al. | 252/32.7 E X |
| 3,255,108 | 6/1966 | Wiese | 252/32.7 E |
| 3,347,790 | 10/1967 | Meinhardt | 252/32.5 |
| 3,385,790 | 5/1968 | Davies et al. | 252/32.7 E |
| 3,390,082 | 6/1968 | Le Suer et al. | 252/32.7 E |
| 3,562,159 | 2/1971 | Mastin | 252/32.7 E |
| 3,923,669 | 12/1975 | Newingham et al. | 252/32.7 E |
| 3,933,659 | 1/1976 | Lyle et al. | 252/32.7 E |

*Primary Examiner*—Helen M. S. Sneed

*Attorney, Agent, or Firm*—Mark J. DiPietro; Arthur G. Gilkes; William T. McClain

[57] ABSTRACT

Disclosed are lubricating oil compositions having improved anti-wear properties, comprising a major portion of a lubricating oil and an effective amount of an oil soluble additive combination comprising a basic zinc alkyl dithiophosphate having alkyl groups made from primary alcohols containing from about 6 to about 20 carbon atoms and a non-acidic lubricating oil anti-rust compound comprising a succinic anhydride substituted with an alkenyl group which has about 8 to about 50 carbon atoms reacted with an alcohol, an amine, or mixtures thereof.

The zinc dithiophosphate is generally made from primary alcohol containing about 7 to about 12 carbon atoms and generally has a zinc to phosphorous ratio of about 1.15–1.5:1.

13 Claims, No Drawings

ANTI-WEAR LUBRICATING OIL COMPOSITIONS

CROSS REFERENCE TO RELATED APPLICATIONS

This application is a continuation in part of U.S. Ser. No. 705,128 which was filed July 14, 1976, now abandoned.

BACKGROUND OF THE INVENTION

This invention relates to lubricating oil compositions. More specifically, it relates to oil compositions having improved anti-wear properties and other beneficial properties.

It is well known that various additives can be added to lubricating oils in order to improve various oil properties and to make a more satisfactory lubricant. Anti-wear agents are intended to decrease wear of the machine parts. Wear inhibitors for incorporation in motor oils and industrial oils are finding greater use as a result of the greater stress placed on moving parts in high performance engines. Numerous additives have been developed for use in such oil compositions to improve the lubricating characteristics thereof and thereby to lessen the wear of the moving parts. Zinc dialkyl dithiophosphate (ZOP) have been long used as anti-wear additives and anti-oxidants in hydraulic oils, motor oils, and aromatic transmission fluids. In spite of the versatility and long use, zinc dialkyl dithiophosphates have several disadvantages. For example, they decompose thermally producing odorous and corrosive by-products and sludges. Other times they decompose hydrolitically when wet producing $H_2S$ and oil soluble solids. They corrode copper when wet causing leaks and solid formation. They react with acidic antirusts when wet forming oil-insoluble sticky zinc soaps which plug the filters, valves, servomechanisms and the like. The use of primary alcohols in the zinc dialkyl dithiophosphate manufacturer reduces thermal instability at the expense of increased hydrolitic instability. Additives are known which will reduce metal corrosion by ZOP; however, many of these act by forming a coating on the metal surface which may increase plugging or sticking of the moving parts.

It is an object of this invention to provide a lubricating oil composition having improved anti-wear properties.

It is an object of this invention to provide a lubricating oil composition having good thermal and hydrolytic stability.

It is a further object of this invention to provide a lubricating oil composition having resistance to corrosion.

It is still further an object of this invention to provide an additive composition which does not form oil and soluble soaps.

SUMMARY OF THE INVENTION

Lubricating oil compositions having improved anti-wear properties comprise a major part of a lubricating oil and an effective amount of oil soluble additive combinations comprising a basic zinc alkyl dithiophosphate having alkyl groups made from primary alcohols containing about 6 to about 20 carbon atoms and a non-acidic lubricating oil anti-rust compound which is the reaction product of a substituted succinic acid anhydride reacted with an alcohol and an amine and mixtures thereof. The zinc dithiophosphate is made from primary alcohols containing about 7 to about 12 carbon atoms and has a zinc to phosphorous ratio of about 1.15–1.5:1. Preferably the zinc dithiophosphate has a zinc to phosphorous ratio of about 1.15–1.35:1. The alkyl substituted succinic acid anhydride has alkenyl groups which contain about 8 to about 50 carbon atoms, preferably about 10 to about 20 carbon atoms. Commonly the anti-rust comprises the oil soluble reaction product of this succinic acid anhydride and an alcohol containing about 2 to about 30 carbon atoms, preferably about 4 to about 20 carbon atoms. This anti-rust also commonly comprises the oil soluble reaction product of the substituted succinic acid or anhydride and an amine containing from about 2 to about 30 carbon atoms, especially 4 to about 20 carbon atoms. Some suitable amines are mono amines, diamines, and polyamines such as alkyamine, polyamine. One preferred group comprises ethylene or propylene polyamines containing about 2 to about 18 carbon atoms.

The ratio of zinc dithiophosphate to anti-rust is about 1–50:1, preferably from about 1–10:1. Generally the oil soluble additive combination is present in the concentration from about 0.05 to about 5 weight percent, preferably from about 0.1 to about 2 weight percent.

PREFERRED EMBODIMENTS

The zinc dialkyl dithiophosphate of this invention such as commercially available as Oronit OLOA 269N, OLOA 269 and ELCO 108 are generally made from dialkyl dithiophosphoric acid having the formula:

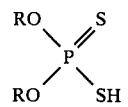

wherein R comprises an alkyl group containing about 7 to about 12 carbon atoms. Alkyl groups originate from primary alcohol. Examples of suitable alcohols are normal alcohols such as n-heptyl, n-octyl, n-decyl, and n-dodecyl or branched chain alcohols such as methyl or ethyl branched isomers of the above.

Suitable branched alcohols are 2-methyl-1-pentanol, 2-ethyl-1-hexanol, 2,2dimethyl-1-octanol, and alcohols prepared from olefin oligomers such as propylene dimer or trimer by hydroboration-oxidation or by the Oxo process. It may be preferable to use mixtures of alcohols because of their low cost and possible improvements in performance.

The dialkyl dithiophosphoric acids are generally made by reaction of about 4 moles of alcohol with one mole of a phosphorus pentasulfide containing about 27 weight percent phosphorus. The phosphosulfurizing agent used is phosphorus pentasulfide. The quality of the phosphorus pentasulfide is of some importance and this reagent should have approximately the following properties:

Melting point, ° F.: 270–280
Wt. percent phosphorus: 25–30
Wt. percent sulfur: 70–75
Free of organic material.

The reaction is preferably but not necessarily conducted in a glass-lined vessel fitted with suitable agitation equipment. Commonly, the reaction is conducted at a temperature from about 100° F. to about 250° F. for a period in the range of about 1–6 hours. The alcohol is preferably free of water.

A convenient method for controlling the end point of the reaction is to measure the specific gravity of the reaction product. The specific gravity will, of course, vary with the reaction temperature and with the excess alcohol content. The end point can also be determined by noting when the evolution of $H_2S$ ceases.

The dialkyl dithiophosphoric acids are then reacted with zinc oxide or zinc hydroxide in order to form the basic zinc dialkyldithiophosphate. By "basic" is meant an excess of ZnO or $Zn(OH)_2$ over what is needed to neutralize the acid. This basic material will generally have a zinc to phosphorus ratio of about 1.15–1.5:1, preferably 1.15–1.35:1. The neutralization reaction is usually carried out at elevated temperatures, e.g. temperatures in the range of about 100° F. to about 300°–400° F. The neutralization is effected, for example, by contacting a zinc oxide slurry with dialkyldithiophosphoric acid for a time sufficient to neutralize the acid, and also incorporate an excess of zinc oxide so that the material is "basic." The reaction may usually be completed within a period of from about 10 minutes to about 4–5 hours. The neutralized product can be used as a corrosion inhibitor without the separation of oil slurrying medium or, if a high-purity zinc dihydrocarbon dithiophosphate is desired, the oil medium may be separated from the salt by solvent extraction, distillation, etc.

Zinc dialkyldithiophosphates can be prepared by batch or continuous processes. In batch processes usually a slurry of zinc oxide in oil is charged to a reaction zone containing dihydrocarbon dithiophosphoric acid and the acid is neutralized by the zinc oxide at elevated temperatures. In continuous processing, the slurry of zinc oxide and the dihydrocarbon dithiophosphoric acid may be charged to one end of a reaction zone, e.g. the upper end of a vertical zone, maintained at elevated temperatures and the product neutralized zinc dihydrocarbon dithiophosphate may be withdrawn from the other end of the reaction zone. If desired, the product from either the batch or continuous process may be further purified by clay percolation or the like to remove insoluble components.

The zinc oxide discussed above is generally used in the form of an oil slurry. It has been found that the more coarse oxides, such as those that can be prepared by the "American Process," a process in which the oxide is prepared directly from the ore by oxidizing the zinc sulfide and zinc sulfate ore to zinc oxide, are capable of slurrying in oil and have, for this reason, heretofore been preferred. The American Process can be controlled to produce either the coarse zinc oxide which has been preferred for use in forming oil slurries for neutralization of dihydrocarbon dithiophosphoric acid or can also be used to produce a finer grade of the zinc oxide. The finer grade zinc oxide, i.e. of smaller particle size than the coarse grade, is also produced by the "French Process" which produces zinc oxide indirectly from the ore, i.e. the ore is reduced to the metal and then oxidized to zinc oxide. Previously the finer grade zinc oxide or finely divided zinc oxide often was not thought useful in the production of zinc dihydrocarbon dithiophosphates because it has been at least extremely difficult to form acceptable slurries of zinc oxide in oil. Where a reasonable amount of oil is utilized in an attempt to slurry the zinc oxide, the greater surface area of the more finely divided zinc oxide often causes thickening and even gelling of the slurry. Such thickened or gelled slurries are not readily pumpable to the neutralization reaction zone. However, some have found this finer material suitable, U.S. Pat. No. 3,086,939.

The oil used in the slurry is preferably a light lubricating oil; however, heavier lubricating oils can be used if desired. The lighter oils are preferred because of their lower viscosities and the greater ease of pumping such oils or slurries containing such oils. Although hydrocarbon oils and particularly petroleum oils were utilized in the procedure set out below, it is intended that other oils can also be used such as the synthetic hydrocarbon polymer oils prepared by the condensation and other methods. Ester oils are not preferred because of the possibility of their dissociation in the presence of zinc oxide under the neutralization reaction conditions. Other useable oils are the distillate fuel oils such as kerosene, heater oils, dewaxed cycle oils and the like. The light lubricating oils are particularly preferred.

One means of introducing the $P_2S_5$ into the reaction vessel is by slurrying the dry $P_2S_5$ with the alcohol or alcohols that are to be used in the process to form the dialkyl-oxy radicals of the dialkyl dithiophosphate. The slurry is preferably kept cold enough to minimize reaction of the $P_2S_5$, and alcohol prior to introduction into the reaction vessel. Sometimes it is also suitable to slurry ZnO or $Zn(OH)_2$ in the same alcohol in order to transport it to the reactor.

The second component of the additive combination of this invention is a nonacidic lubricating oil anti-rust compound. By nonacidic is meant those anti-rusts which do not have any appreciable number of free acid groups. These nonacidic compounds generally have a neutralization number of less than about 100 as determined by the ASTM D-974 method. These anti-rusts are generally comprised of an oil soluble reaction product of a hydrocarbon substituted succinic anhydride or acid and the reaction product of an alcohol, amine, or mixtures thereof. The hydrocarbyl or bromo or hydroxy substituant of the hydrocarbyl succinic anhydride can be saturated or unsaturated, branched or unbranched. Most importantly, it will be of such a nature that the final nonacidic anti-rust is oil soluble. These oil soluble hydrocarbyls can be of relatively low molecular weights such as those having about 6 to 60 carbon atoms. Generally succinic acids up to about 50 carbon atoms are the most effective rust inhibitors. However, most importantly, the number of carbon atoms in the hydrocarbyl part of the acid or number of carbon atoms in the alcohol or amines should be such that the material is oil soluble and an effective anti-rust as determined by ASTM D-665.

Substituted succinic anhydride is often made by the reaction of maleic anhydride with olefinic materials. Some preferred olefinic materials are low molecular weight alpha-olefins or polymeric olefins. The term "polymer olefins" as used herein refers to amorphous copolymers derived from olefinicially unsaturated monomers. Such olefin monomers include olefins of the general formula $RCH{=}CH_2$, in which R is an aliphatic or cycloaliphatic radical of from 1 to about 20 carbon atoms, for example propene, isobutylene, butene-1, hexene-1, 4-methyl-1-pentene, decene-1, vinylidene norbornene, 5-methylene-2-norbornene, etc. Other olefin monomers having a plurality of double bonds may be used, in particular diolefins containing from about 4 to about 25 carbon atoms, e.g., 1,4-butadiene, 2,3-hexadiene, 1,4-pentadiene, 2-methyl-2,5-hexadiene, 1.7-octadiene, etc. These olefins often have number average molecular weights from about 100 to about 700, more preferably from about 100 to about 220. Of these polymers, a preferred group are polypropylene or butylene polymers. A number of the substituted succinic anhydrides are commercially available.

The alcohols which are sometimes used in the preparation of the non-acidic anti-rust commonly contains about 2 to about 30 carbon atoms, preferably from about 4 to about 20 carbon atoms. The alcohols can be monoalcohols such as ethyl, propyl, butyl, pentyl, hexyl, heptyl, octyl, decyl, dodecyl, hexadecyl, octadecyl, and the like. The alcohols may be branched or unbranched, may contain unsaturation, and may be mixtures of alcohols as those made by hydroboration-oxidation or by the Oxo process. It may be preferable to use mixtures of alcohols because of their low cost and possible improvements in performance. The alcohols may also be polyols such as ethylene glycol, propylene glycol, glycerol and diethylene glycol and others.

The amines which are sometimes used in the preparation of the non-acidic anti-rust commonly contain about 2 to about 30 carbon atoms, preferably from about 4 to about 20 carbon atoms. These amines can be mono amines, diamines or polyamines. The amine may be primary, secondary, although primary amines react more readily with carboxylic acids. Examples of some suitable amines are ethyl amine, diethyl amine, butyl amine, dimethyl amine, propylamine, dipropylamine, isopropyl amine, butyl amine, isobutyl amine, cyclohexylamine, benzylamine and the like. The amine may be branched or unbranched, and may contain unsaturation.

The amine may also be hydroxy substituted such as ethanol amine, diethanol amine and triethanol amine. This latter amine will probably react as an alcohol rather than an amine with a carboxylic acid.

The amines and alcohols used in the non-acidic anti-rust may be substituted with hydroxy, bromo or chloro groups provided it does not destroy the additives' solubility and does not destroy effectiveness as an anti-rust.

One preferred group of amines are alkylene polyamines. Suitable alkylene polyamine reactants include ethylenediamine, diethylene triamine, triethylene tetramine, tetraethylene pentamine, pentaethylene hexamine, hexaethylene heptamine, heptaethylene octamine, octaethylene nonamine, nonaethylene decamine, decaethylene undecamine and mixtures of such amines having nitrogen contents corresponding to the alkylene polyamines, in the formula $H_2H—(A\text{-}NH—)_nH$, where A is a divalent ethylene and $n$ is an integer from 1 to 10. Corresponding propylene polyamines such as propylene diamine and di-, tri-, tetra-, penta-propylene tri-, tetra-, penta- and hexa- amines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

The lubricating oils in which the compositions of this invention are useful as additives and which comprise a major proportion of the lubricating oil compositions may be of synthetic, animal, vegetable, or mineral origin. Ordinarily mineral lubricating oils are preferred by reason of their availability, general excellence, and low cost. For certain applications, oils belonging to one of the other three groups may be preferred. For instance, synthetic polyester oils such as didodecyl adipate and di-2-ethylhexyl sebacate are often preferred as jet engine lubricants. Normally the lubricating oils preferred will be fluid oils, ranging in viscosity from about 40 Saybolt Universal seconds at 100° F. to about 200 Saybolt Universal seconds at 210° F. This invention contemplates also the presence of other additives in lubricating compositions. Such additives include, for example, viscosity index improving agents, pour point depressing agents, anti-foam agents, extreme pressure agents, rust-inhibiting agents, and oxidation and corrosion inhibiting agents.

The additive combination of this invention is generally added to lubricating oil in order to improve the anti-wear properties of said oil. Depending on the nature of the oil, the intended use and the desired improvement, different amounts of the additive are needed in order to be effective. Generally about 0.05 to about 5 weight percent, preferably from about 0.1 to about 2 weight percent, of the additive is used.

Formation of sludge due to thermal degradation was determined when formulated oil was heated at 300° F. in the presence of bubbling air and copper and iron catalyst for 96 hours. The percent sludge was calculated after filtration through a 0.5 micron Millipore filter. 100 grams of the formulated oil is placed in a glass tube ca. 12 inches long and 1¼ inches in diameter. 15 inch lengths of copper and iron wire are cleaned and coiled as described in ASTM D-943 and immersed in the oil. The tube is inserted to a depth of 9 inches in an aluminum block electrically heated to 300° F. Dry air is bubbled through the oil at a rate of 50 cc/min. A water-cooled condenser is attached to the top of the tube. After 96 hours, the tube is removed from the heated block and allowed to cool to room temperature. The oil is decanted and the tube and metal catalyst washed with 100 ml ASTM isooctane. The oil and wash solvent is combined and filtered through a 0.45 micron Millipore filter.

Hydrolytic instability was demonstrated by heating at 100° C. for 48 hours, a sample of formulated oil in which has been dispersed 1% of distilled water. Evolution of $H_2S$ and/or formation of solid deposits show poor water tolerance. 100 grams of the formulated oil and 1.0 gram distilled water are placed in an 8 ounce bottle and heated to 210°–215° F. in an oven. When the oil reaches test temperature the bottle is removed from the oven, capped tightly and shaken vigorously to mix oil and water. The capped bottle is returned to the oven for 24 hours. It is then removed, re-shaken, and returned to the oven. After an additional 24 hours, the bottle is removed from the oven, re-shaken and allowed to cool to room temperature in the dark for at least 24 hours. The oil is then observed for evidence of instability: $H_2S$ formation is detected by odor and/or blackening of moistened lead acetate test paper. The oil is filtered through a 5 micron Millipore filter and the time required for filtration is noted. The weight and appearance of the residue are determined.

EXAMPLE 1

Anglamol 75, a zinc dialkyldithiophosphate (ZOP) made from mixed secondary alkyl alcohols plus an alkenylsuccinic acid rust inhibitor, at 1.0% volume was tested in a base oil made by blending SAE 10 and 20 weight solvent-extracted, hydrogenated base stocks to give an oil with a viscosity of 210 SUS at 100° F. The test oil additionally contained a poly-methylacrylate pour depressant (Acryloid 703) at 0.2% vol. and a silicone antifoam (Dow Corning 200 fluid) at 2 ppm.

EXAMPLE 2

0.8 volume percent Lubrizol 1360, a ZOP made from mixed primary alkyl alcohols some of which may be branched, and 0.15 volume percent of rust inhibitor Hitec E536, was tested in the same base oil as Example 1. The same pour depressant and antifoam were used. Hitec E536 is a non-acidic anti-rust condensation product of dodecenyl succinic acid and a polyamine, having a total of about 2.6 percent nitrogen and an acid number of about 56.

EXAMPLE 3

1.0 volume percent Oronite 973B, a ZOP made from primary alkyl alcohols plus an alkenylsuccinic acid rust inhibitor, was tested in the same base oil as Example 1. The same pour depressant and anti-foam were used.

EXAMPLE 4

0.8 volume percent of OLOA 269N, a ZOP made from primary octyl alcohol, and 0.15 volume percent Hitec E 536 were tested in the same base oil as Example 1. The same pour depressant and antifoam were used.

EXAMPLE 5

1.0 weight percent Lubrizol 1060, a ZOP prepared from secondary aliphatic alcohols, and 0.1 weight percent of an acidic rust inhibitor, comprising a 50 volume percent solution of dodecenyl succinic acid in transformer oil, were tested in a solvent extracted SAE 10 weight Midcontinent petroleum stock.

EXAMPLE 6

1.0 weight percent of Lubrizol 1060, a ZOP prepared from secondary aliphatic alcohols and 0.1 weight percent of Hitec E-536 were tested in the same base oil as Example 5.

EXAMPLE 7

1.0 weight percent of Lubrizol 1360, a ZOP made from mixed primary alkyl alcohols some of which may be branched, and 0.1 weight percent of a 50 volume percent solution of dodecenyl succinic acid in transformer oil, were tested in the same base oil as Example 5.

EXAMPLE 8

1.0 weight percent of Lubrizol 1360, a ZOP made from mixed primary alkyl alcohols some of which may be branched, and 0.1 weight percent of Hitec E-536 were tested in the same base oil as Example 5.

EXAMPLE 9

1.0 weight percent OLOA 269N, an overbased ZOP made from primary alkyl alcohol, and 0.1 weight percent of a 50 volume percent solution of dodecenyl succinic acid in transformer oil, were tested in the same base oil as Example 5.

EXAMPLE 10

1.0 weight percent OLOA 269N, an overbased ZOP made from primary alkyl alcohol, and 0.1 weight percent Hitec E-536, were tested in the same base oil as Example 5.

EXAMPLE 11

1.0 weight percent OLOA 269R, an overbased zinc di-(2-ethyl-1-hexyl) dithiophosphate and 0.1 weight percent of a 50 volume percent dodecenyl succinic acid in transformer oil, were tested in the same base oil as Example 5.

EXAMPLE 12

1.0 weight percent OLOA 269R, an overbased zinc di-(2-ethyl-1-hexyl) dithiophosphate, and 0.1 weight percent Hitec E-536, were tested in the same base oil as Example 5.

TABLE I

| Example | 1 | 2 | 3 | 4 |
|---|---|---|---|---|
| Sludge Formation, 300° F, 96 hr. % sludge | 0.40 | 0.033 | 0.021 | 0.033 |
| Hydrolytic Instability | | | | |
| Insoluble Residue, % | 0.049 | 0.132 | 0.010 | 0.011 |
| $H_2S$ Evolved | Yes | Yes | No | No |
| D2619 Wet Copper Corrosion | | | | |
| Copper Loss mg/cm²* | 0.38–0.52 | 0.38–0.78 | 0.19–0.28 | 0.17–0.25 |
| Copper Appearance | 2-C | 4A–4B | 2-D | 1A–1B |
| $H_2S$ Evolved | No | No | No | No |

*Note: The first number is after solvent cleaning (only) of the copper strip; the second number is for the same strip after removal of chemically-bound copper with a 10% KCN solution.

TABLE II

| Example | 5 | 6 | 7 | 8 | 9 | 10 | 11 | 12 |
|---|---|---|---|---|---|---|---|---|
| Sludge Formation, % 300° F, 72 hours | 0.45 | 0.43 | 0.0009 | 0.0011 | 0.0007 | 0.0032 | 0.0006 | 0.0006 |
| Hydrolytic Instability | | | | | | | | |
| Insol. Residue, % | 0.15 | 0.17 | 0.19 | 0.010 | 0.061 | 0.007 | 0.007 | 0.002 |
| $H_2S$ Evolved | Yes | Yes | Yes | No | Yes | No | No | No |
| D2619 Wet Copper Corrosion | | | | | | | | |
| Cu Loss mg/cm²* | 1.31–1.61 | 0.63–0.87 | 1.30–1.92 | 1.19–1.52 | 0.19–0.43 | 0.27–0.29 | 0.07–0.14 | 0.08–0.12 |
| Cu Appearance | Brown 4-C | Brown 4-C | 4-B | Brown 4-C | 4-A | 1-B | 2-D | 1-B |
| $H_2S$ Evolved | No | No | No | No | Yes | No | No | No |

*See note in Table I.

Note: Type C test only 72 hr., rather than 96 hr. as in previous table. There is no standard test length and the time before oxidation of the base oil begins to take place is somewhat less for this oil than for the oil used in the previous table.

I claim:

1. A lubricating oil composition having improved anti-wear properties comprising a major portion of lubricating oil and an effective amount of an oil soluble additive composition comprising a basic zinc alkyl dithiophosphate having alkyl groups made from primary alcohols containing from about 6 to about 20 carbon atoms and a nonacidic lubricant anti-rust compound comprising the reaction product of a succinic anhydride substituted with an alkenyl group which has 8 to 20 carbon atoms and an alcohol, an amine or mixtures thereof, wherein the ratio of zinc alkyl dithiophosphate to anti-rust is about 1–50:1.

2. The composition of claim 1 wherein the zinc dithiophosphate is made from primary alcohols containing about 7 to about 12 carbon atoms.

3. The composition of claim 1 wherein the zinc dithiophosphate has a zinc diphosphorous ratio of about 1.15–1.5:1.

4. The composition of claim 1 wherein the zinc dithiophosphate has a zinc diphosphorous ratio of about 1.15–1.35:1.

5. The composition of claim 1 wherein the alkenyl group of the substituted succinic anhydride has from 10 to about 20 carbon atoms.

6. The composition of claim 1 wherein the alcohol is an alcohol from about 2 to about 30 carbon atoms.

7. The composition of claim 6 wherein the alcohol is an alcohol of from about 4 to about 20 carbon atoms.

8. The composition of claim 1 wherein the amine has from about 2 to about 30 carbon atoms.

9. The composition of claim 8 wherein the amine has from about 4 to about 20 carbon atoms.

10. The composition of claim 8 wherein the amine is a polyamine which has from about 2 to about 18 carbon atoms.

11. The composition of claim 1 wherein the oil soluble additive combination is present at a concentration of from about 0.05 to about 5 weight percent.

12. The composition of claim 11 wherein the oil soluble additive combination is present in a concentration of from about 0.10 to about 2 weight percent.

13. The composition of claim 1 wherein the lubricating oil has a viscosity from about 40 Saybolt Universal Seconds at 100° up to about 200 Saybolt Universal Seconds at 10°.

* * * * *

UNITED STATES PATENT OFFICE
CERTIFICATE OF CORRECTION

Patent No. 4,094,800 Dated June 13, 1978

Inventor(s) Thomas M. Warne

It is certified that error appears in the above-identified patent and that said Letters Patent are hereby corrected as shown below:

| Patent Column | Line | |
|---|---|---|
| 4 | 66 | "1.7-octadiene" should be -- 1,7-octadiene --. |
| 5 | 41-42 | "tetramine" should be -- tetraamine --. |
| 5 | 50 | "penta-propylene tri," should be -- penta-propylene, tri --. |
| 1 | 40 | "hydrolitic" should be -- hydrolytic --. |
| 10 | 17 | "10°" should be -- 210° --. |
| 1 | 32-33 | "hydrolitically" should be -- hydrolytically --. |

UNITED STATES PATENT OFFICE

CERTIFICATE OF CORRECTION

Patent No. 4,094,800 Dated June 13, 1978

Inventor(s) Thomas M. Warne

It is certified that error appears in the above-identified patent and that said Letters Patent are hereby corrected as shown below:

| Patent Column | Line | |
|---|---|---|
| 9 | 7 | "zinc diphosphorous" should be --zinc to phosphorous-- |
| 9 | 10 | "zinc diphosphorous" should be --zinc to phosphorous-- |

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*